US005609747A

United States Patent [19]

Sakurai et al.

[11] Patent Number: 5,609,747

[45] Date of Patent: Mar. 11, 1997

[54] METHOD OF DISSOLVING ZINC OXIDE

[75] Inventors: Akio Sakurai; Tamotsu Mizuta; Yasuhide Okada; Hiroshi Nakano; Takao Ikenaga; Osamu Shin; Yuuji Ikenaga, all of Okayama, Japan

[73] Assignee: Kawasaki Steel Corporation, Japan

[21] Appl. No.: 567,350

[22] Filed: Aug. 17, 1995

[51] Int. Cl.[6] ..... C25D 5/00

[52] U.S. Cl. ..... 205/246; 205/245; 205/244; 205/305

[58] Field of Search ..... 205/246, 245, 205/244, 305

[56] References Cited

U.S. PATENT DOCUMENTS 4,401,523 8/1983 Avellone ..... 205/96
4,610,937 9/1986 Ito et al. ..... 205/246
4,663,000 5/1987 Liu ..... 205/305
4,684,450 8/1987 Everett ..... 205/602

*Primary Examiner*—Arun S. Phasge
*Attorney, Agent, or Firm*—Austin R. Miller

[57] ABSTRACT

A method of dissolving zinc oxide in which, to perform continuous zinc-system electroplating of a steel sheet using an insoluble anode, particularly continuous zinc-nickel alloy electroplating, a dissolution bath is provided in a circuit for a sulfuric acid plating liquid, and zinc oxide is dissolved in the plating liquid in the dissolution bath. The amount of zinc oxide thrown in is controlled during dissolution of zinc oxide so that the pH of the plating liquid at an outlet of the dissolution bath does not exceed 2.3.

5 Claims, 3 Drawing Sheets

METHOD OF DISSOLVING ZINC OXIDE

BACKGROUND OF THE INVENTION

1. Field of the Invention

The present invention relates to a zinc system-plated steel sheet, plated by continuous steel electroplating using an insoluble anode and, more particularly, to a method of dissolving zinc oxide to supply a sulfuric acid plating liquid with zinc ions consumed in a process of manufacturing a steel sheet plated with a zinc alloy, such as zinc-nickel alloy.

2. Description of the Related Art

Recently, the demand for improvements in corrosion resistance has significantly increased in the fields of motor vehicles and electrical home appliances. Alloy-plated steel sheets such as recently developed zinc-nickel-plated steel sheets and the like are now in markedly increased demand.

To cope with such increasing demands, a high-speed electroplating method using a high current density, to enable high-efficiency production, is adopted. Needless to say, in high-speed electroplating, a method of continuously supplying consumed metallic ions by using an insoluble anode, such as an iridium-system anode, which needs no interchange, is more advantageous than soluble anode methods in which anode interchange must be frequently made.

In such continuous electroplating, a mineral acid electrolytic solution such as sulfuric acid is ordinarily used as a plating liquid, and methods of supplying zinc ions to a plating liquid are generally grouped into methods of dissolving metal zinc by bringing it into direct contact with a plating liquid and methods of dissolving a zinc compound such as zinc oxide.

Ordinarily, if an insoluble anode is used, it is necessary to supply a large amount of zinc ions to a plating bath, and a method of dissolving metal zinc is adopted because it is low-cost.

However, metal zinc has a low dissolving rate in sulfuric acid plating liquids. Therefore, it is necessary to use an additional method of increasing the contact area with the plating liquid by roughening the surface of the zinc plate or using a fine zinc powder, or using a method of increasing the residence time. Working the metal zinc into a fine powder, however, increases the manufacturing cost, and a considerably large equipment cost is required to increase the residence time.

Therefore, a method has also been proposed in which low-priced metal zinc and a zinc compound such as zinc oxide having a high dissolving rate are used in combination and two comparatively small dissolution baths at upstream and downstream positions. However, if zinc-nickel alloy electroplating is performed by using this method, a substitutional precipitation phenomenon occurs between the zinc source and nickel sulfate dissolved in the plating liquid circulatory which is used to cause the nickel (which is a "precious" metal) to precipitate. This occurs as long as metal zinc is used as the zinc source. Then, a need for recovering and reusing high-priced metal nickel arises. Thus, this method is not always advantageous in terms of cost.

Methods of dissolving a zinc compound free from substitutional precipitation and having a comparatively high dissolving rate in a plating liquid have therefore been proposed.

Japanese Patent Laid-Open No. 85531/1975 discloses a method of using one of zinc hydroxide and zinc carbonate, a mixture of these compounds or a mixture of these compounds and zinc oxide, and Japanese Patent Laid-Open No. 87689/1981 discloses a method of dissolving zinc oxide or basic salt of zinc. However, if a zinc compound such as zinc oxide is directly thrown into an acid plating liquid, agglomeration is liable to occur due to heat of reaction or the like caused on the surfaces of powder particles, and the agglomerated compound does not dissolve.

Japanese Patent Publication No. 13639/1983 then discloses an improved method in view of this problem, i.e., a method of previously dispersing zinc oxide or basic salt in water before throwing it into a plating bath. This method prevents agglomeration but entails a new problem of requiring a high-speed agitator (homogenizer) for dispersion treatment and a water removing means such as an evaporator, since an excessively large amount of water is supplied to the plating liquid.

The inventors of the present invention have studied various methods for efficiently dissolving zinc oxide in a sulfuric acid plating liquid circulated between a plating bath and a dissolution bath, and thereby discovered that, in the dissolution bath, depending upon the pH range thereof, iron ions eluted from a steel sheet precipitate as an iron compound of an unknown structure, and that such a precipitate forms a film on the surface of zinc oxide to prevent dissolution of zinc oxide.

As described above, no satisfactory method has presently been discovered for supplying zinc ions in continuously electroplating using an insoluble anode.

SUMMARY OF THE INVENTION

In view of the above-described problems, an object of the present invention is to provide a method of dissolving zinc oxide stably and efficiently by using a simple apparatus.

To achieve this object, according to one aspect of the present invention, there is provided a method of dissolving zinc oxide in which, to perform continuous zinc-system electroplating of a steel sheet using an insoluble anode, particularly continuous zinc alloy electroplating with zinc-nickel alloy or the like, a dissolution bath is provided in a circuit for a sulfuric acid plating liquid, and zinc oxide is dissolved in the plating liquid in the dissolution bath. This method comprises monitoring the pH of the plating liquid at an outlet of the dissolution bath, and controlling the amount of zinc oxide thrown in so that pH thereof does not exceed 2.3.

According to a second aspect of the present invention, there is provided a method of dissolving zinc oxide in which, to perform continuous zinc-system electroplating of a steel sheet using an insoluble anode, particularly continuous zinc alloy electroplating with zinc-nickel alloy or the like, a dissolution bath is provided in a circuit for a sulfuric acid plating liquid, and zinc oxide is dissolved in the plating liquid in the dissolution bath. This method comprises monitoring the pH of the plating liquid at an inlet side of the dissolution bath, and stopping or reducing the amount of zinc oxide thrown in when the pH thereof becomes equal to or greater than 1.8, in order that the pH of the plating liquid at an outlet side of the dissolution bath does not exceed 2.3.

According to a third aspect of the present invention, there is provided a method of dissolving zinc oxide in which, to perform continuous zinc-system electroplating of a steel sheet using an insoluble anode, particularly continuous zinc alloy electroplating with zinc-nickel alloy or the like, a dissolution bath is provided in a circuit for a sulfuric acid plating liquid, and zinc oxide is dissolved in the plating liquid in the dissolution bath. This method comprises monitoring the pH of the plating liquid in the dissolution bath, and controlling the amount of zinc oxide thrown in so that the pH thereof is maintained at 1.8 to 2.3 in order that the pH of the plating liquid at an outlet side of the dissolution bath does not exceed 2.3.

According to a fourth aspect of the present invention, there is provided a method of dissolving zinc oxide in which, to perform continuous zinc-system electroplating of a steel sheet using an insoluble anode, particularly continuous zinc alloy electroplating with zinc-nickel alloy or the like, a dissolution bath is provided in a circuit for a sulfuric acid plating liquid, and zinc oxide is dissolved in the plating liquid in the dissolution bath. This method comprises dissolving zinc oxide in the plating liquid having a pH value of equal to or smaller than 1.8 at an inlet side of the dissolution bath by throwing in zinc oxide at a rate of 0.01 to 10.0 kg with respect to 1 $m^3$ of the plating liquid in order that the pH of the plating liquid at an outlet side of the dissolution bath does not exceed 2.3.

DESCRIPTION OF THE PREFERRED EMBODIMENT

Figure 1:
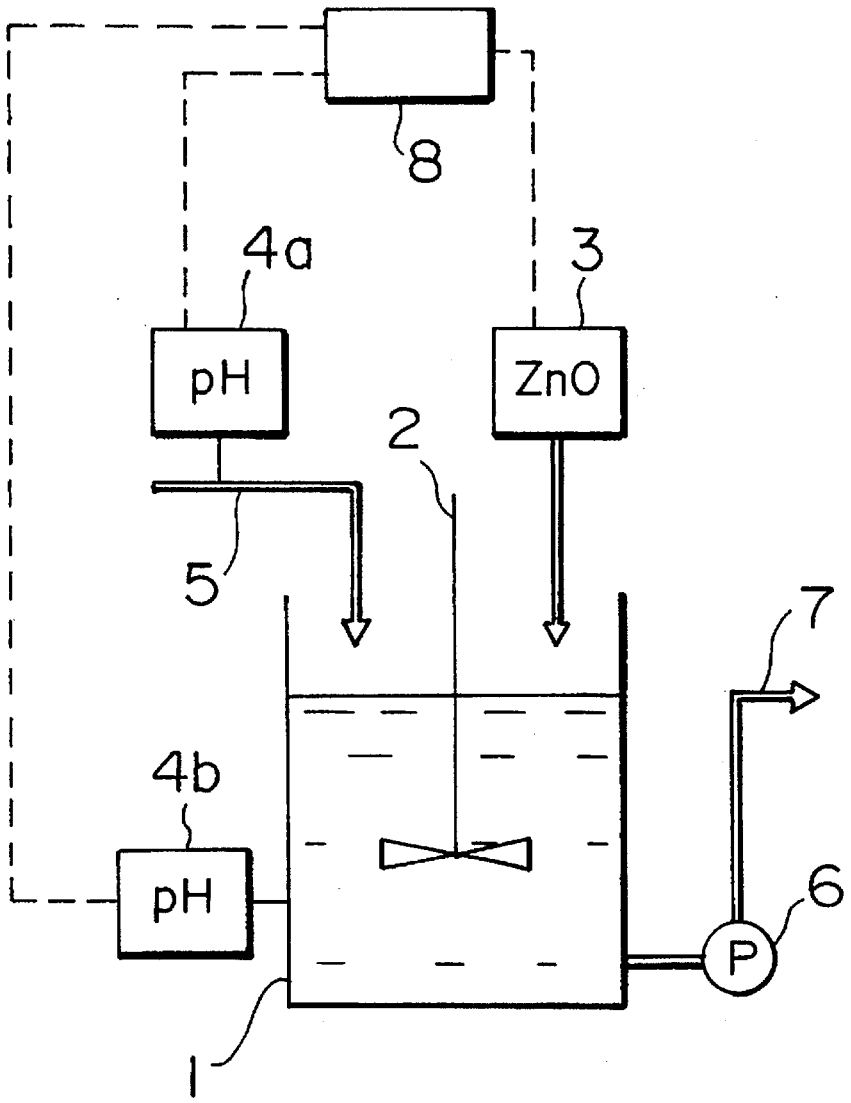
FIG. 1 is a diagram showing the construction of an example of a dissolution apparatus of the present invention.

As described above, the present invention relates to a method of dissolving zinc oxide. Zinc-system plating referred to hereinafter is such that a plating layer on a steel sheet contains zinc. That is, plating of the present invention includes zinc alloy system plating such as zinc-nickel alloy plating and zinc-iron alloy plating as well as zinc plating, and further includes plating by lamination of these kinds of plating. Specifically, an application of the present invention to zinc-nickel alloy plating is preferred, for example, in terms of prevention of substitutional precipitation.

The reaction of a metal band in a plating bath for continuous zinc-system electroplating using an insoluble anode is expressed by the following formulae:

$$\text{Cathode: } Zn^{2+}+2e^{-}\rightarrow Zn \quad (1)$$

$$\text{Anode: } H_2O\rightarrow 2H^{+}+2e^{-}+\tfrac{1}{2}O_2\uparrow \quad (2)$$

That is, the metal band used as a cathode is plated with zinc to consume zinc ions, and hydrogen ions generated at an anode are increased, so that the pH of a sulfuric acid plating liquid is reduced.

On the other hand, the dissolution reaction of zinc oxide in a dissolution bath, which is provided so that the sulfuric acid plating liquid in the plating bath can circulate through these baths, is caused in the presence of hydrogen ions in the plating liquid as expressed by the following formula:

$$ZnO+2H^{+}\rightarrow Zn^{2+}+H_2O \quad (3)$$

By this reaction, hydrogen ions in the plating liquid are consumed, so that the pH increases. This sulfuric acid plating liquid is again circulated to the plating bath to supply zinc ions.

The present invention relates to a method of dissolving zinc oxide in this dissolution bath.

The inventors examined the conditions of the dissolution of zinc oxide in the sulfuric acid plating liquid in this dissolution bath, and discovered that the plating liquid contains iron ions eluted from the steel sheet, and that, if the pH increases in the dissolution bath, iron ions precipitate into an iron compound of unknown structure, forming a film which covers the surface of zinc oxide, impeding the dissolution of the zinc oxide.

Although this iron compound film was not identified, it was confirmed that, if the pH value of the dissolution bath exceeds 2.3 when zinc oxide is dissolved in the sulfuric acid plating liquid, this iron compound film is formed on the surface of zinc oxide, and that this film affects the dissolution reaction and reduces the reaction rate.

It was then discovered that there are two effective steps of: 1) setting the pH of the plating liquid at an inlet side of the dissolution bath to a value sufficiently smaller than 2.3 (e.g., 1.8 or less) to increase the amount of hydrogen ions contributing to the dissolution of the Reaction described in equation (3); and 2) controlling the pH during the dissolving process to control the progress of the film forming reaction.

Figure 3:
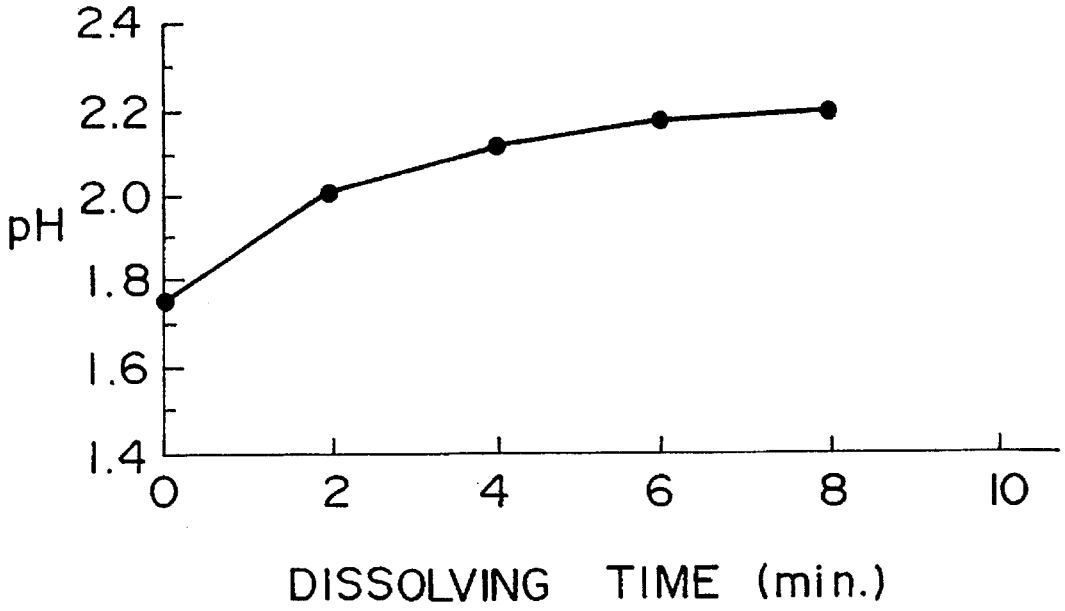
FIG. 3 is a graph of changes in pH in dissolution of zinc oxide.

The inventors of the present invention made an agitating dissolution experiment by putting 1 $m^3$ of a sulfuric acid plating liquid having a pH of 1.75 in a small dissolution bath and throwing 6 kg of zinc oxide into the bath. FIG. 3 is a graph showing changes in pH with respect to elapse of time in this experiment.

As shown in FIG. 3, the range of change in pH decreases 4 minutes after the start of dissolution, i.e., at the time when pH of the sulfuric acid plating liquid exceeds 2.1, and dissolution of zinc oxide is difficult when the pH value is equal to or larger than 2.3.

From these results of the experiment, it was found that

1) If the pH of the sulfuric acid plating liquid exceeds 2.1, the change in pH becomes smaller, that is, the dissolution reaction is dampened,
2) If the pH of the sulfuric acid plating liquid exceeds 2.1, generation of an iron compound of an unknown structure is started and the dissolution reaction is dampened.

A study was made on the basis of these results with respect to the amount of zinc oxide initially thrown in, and it was found that, if the amount of zinc oxide initially thrown in is reduced, a good dissolubility can be maintained when the pH value is not larger than about 2.3.

A study was then made on the zinc oxide addition rate with respect to a unit flow rate of the plating liquid having a pH equal to or smaller than 1.8 at the inlet of the dissolution bath. As a result, it was found that, if zinc oxide is dissolved in the plating liquid having a pH value of equal to or smaller than 1.8 at an inlet side of the dissolution bath by being thrown in at a rate of 0.01 to 10.0 kg with respect to 1 $m^3$ of the plating liquid, dissolution is completed in five minutes and the concentration of zinc ions in the supplied plating liquid can be suitably maintained. More preferably, this throw-in rate is 0.1 to 2 kg if the adaptability to the rate and pH of ordinary continuous electroplating is considered.

In the present invention, it is natural that, only in view of the purpose of dissolution, stronger agitation and stronger shaking in the dissolution bath are preferred as well as a higher temperature of the plating liquid. However, for the reason of the complexity and cost of apparatus, agitation at 100 to 200 rpm and a plating liquid temperature of about 50° to 70° C. are ordinarily preferred.

For ease of understanding of the present invention, examples of a dissolution apparatus for carrying out dissolution in accordance with the present invention and examples of the method of operating the apparatus will be described with reference to FIGS. 1 and 2.

Figure 2:
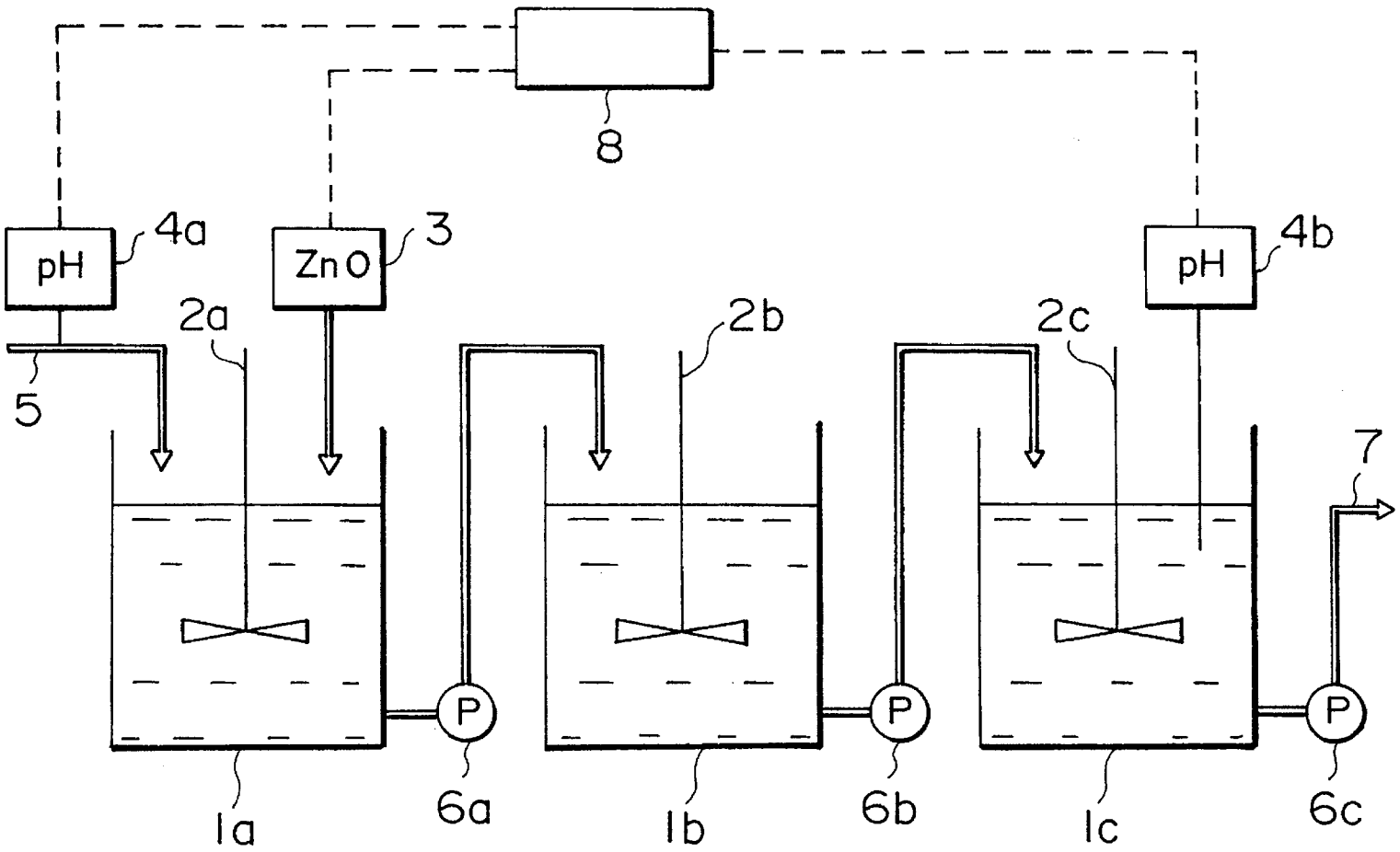
FIG. 2 is a diagram showing the construction of another example of the dissolution apparatus of the present invention.

Identical or corresponding components in FIGS. 1 and 2 are indicated by the same reference characters. FIGS. 1 and 2 illustrate a dissolution bath 1, an agitator 2, a zinc oxide supplier 3, a PH-meters 4*a* and 4*b*, return pipe 5 from a plating bath (an inlet pipe of the dissolution bath), a liquid feed pipe 6, pipe 7 for feeding to the plating bath (an outlet pipe of the dissolution bath) and a control device 8.

To carry out the present invention, a plating liquid storage bath may also be provided between the dissolution bath and the plating bath. In particular, if alloy plating such as zinc-nickel alloy plating is performed, mixing with a plating liquid in which metallic ions other than zinc ions (e.g., a nickel dissolving plating liquid, regulation or the like) is performed in such a storage bath. In such a case, both the receiving and supplying pipes 5 and 7 are connected to the plating storage bath, and two pipes are also provided for connection between the storage bath and the plating bath.

In the arrangement shown in FIG. 1, only one dissolution bath 1 is provided and the pH value of the plating liquid in the liquid supply pipe 5 supplied to this dissolution bath 1 is monitored with pH-meter 4*a*. If the measured value exceeds a predetermined pH value (e.g., 1.8), the supply of zinc oxide by the zinc oxide supplier 3 is stopped, sulfuric acid is thrown directly into the plating liquid, or the like is performed in accordance with a program previously set in the control device 8. On the other hand, the pH value of the solution in the dissolution bath 1 is monitored with pH meter 4*b*. If this measured value exceeds a predetermined pH value (e.g., 2.3), the supply of zinc oxide by the zinc oxide supplier 3 is stopped or the like is performed.

In the arrangement shown in FIG. 2, three baths (1*a*, 1*b*, 1*c*) provided as dissolution bath 1 are disposed to form a batch operation system. The pH value of the plating liquid in the liquid supply pipe 5 supplied to the first bath 1*a* is monitored with pH-meter 4*a*. If this measured value exceeds a predetermined pH value, the supply of zinc oxide by the zinc oxide supplier 3 or the like is stopped in accordance with a program previously set in the control device 8. On the other hand, the pH value in the dissolution baths, represented by that of the solution in the third bath l*c*, is monitored with pH-meter 4*b*. If this measured value exceeds a predetermined pH value, the operation of stopping the supply of zinc oxide by the zinc oxide supplier 3 or the like is performed, as in the case of the arrangement shown in FIG. 1.

EXAMPLES

Examples of the dissolution method of the present invention will next be described.

Example 1

Zinc plating was performed by continuous electroplating using iridium oxide as an insoluble anode and a cold-rolled steel sheet as a cathode and using a sulfuric acid plating liquid. For this plating, a dissolution tank having a capacity of 15 $m^3$ was used. In the dissolution bath, a zinc plating liquid having a zinc concentration of 90 g/l, a pH of 1.6 and a liquid temperature of 60° C. was introduced at a circulation rate of 200 $m^3$/hr. Zinc oxide was added at a rate of 1 kg with respect to 1 $m^3$ of the plating liquid and was dissolved by being agitated with a rotor at 100 rpm. As a result, the entire amount of zinc oxide was dissolved substantially completely in five minutes.

Example 2

Zinc-nickel alloy plating was performed by continuous electroplating using iridium oxide as an insoluble anode and a cold-rolled steel sheet as a cathode and using a sulfuric acid plating liquid. For this plating, a dissolution tank having a capacity of 15 $m^3$ was used. In the dissolution bath, a zinc-nickel plating liquid having a zinc concentration of 90 g/l, a nickel concentration of 80 g/l, a pH of 1.4 and a liquid temperature of 60° C. was introduced at a circulation rate of 200 $m^3$/hr. Zinc oxide was added at a rate of 1 kg with respect to 1 $m^3$ of the plating liquid and was dissolved by being agitated with a rotor at 100 rpm. As a result, the entire amount of zinc oxide was dissolved substantially completely in four minutes.

In conventional processes, only about 84% of zinc oxide was dissolved during a time period of five minutes or longer. In contrast, in the case of the present invention, 99% or more of zinc oxide was dissolved in five minutes. Thus, according to the present invention, only a small sample set of equipment may suffice to stably maintain a dissolution rate and to significantly improve dissolution yield, without requiring a large or high-priced dispersing machine or the like.

Although the invention has been disclosed by showing specific embodiments thereof, the preferred embodiments are for purposes of illustration only and the invention is not limited thereto. Other modifications and variations, as will become apparent to those skilled in the art, are all within the spirit and scope of this invention as defined in the appended claims.

What is claimed is:

1. In a method of dissolving zinc oxide during continuous zinc-system electroplating of a steel sheet, using an insoluble anode and a dissolution bath providing a circuit for a sulfuric acid plating liquid, said method comprising the steps of:

circulating said plating liquid through said dissolution bath, dissolving said zinc oxide in said plating liquid in said dissolution bath, monitoring the pH of said plating liquid while in said dissolution bath, controlling the amount of said zinc oxide thrown into said dissolution bath so that said pH of said plating liquid at said outlet of said dissolution bath is less than about 2.3.

2. The method of dissolving zinc oxide according to claim 1, wherein said amount of said zinc oxide in is controlled so that said pH of said plating liquid at an inlet of said dissolution bath is at least about 1.8.

3. The method of dissolving zinc oxide according to claim 1, wherein, during said dissolving of said zinc oxide, said amount of said zinc oxide thrown in is controlled so that said pH of said plating liquid in said dissolution bath is between about 1.8 to 2.3.

4. The method of dissolving zinc oxide according to claim 1, wherein said zinc oxide is dissolved by being thrown into said plating liquid at a rate of 0.01 to 10.0 kg with respect to 1 $m^3$ of said plating liquid, and wherein said plating liquid having a pH value of less than about 1.8 at an inlet of the dissolution bath.

5. The method of dissolving zinc oxide according to claim 1, wherein said continuous zinc-system electroplating comprises continuous zinc-nickel alloy electroplating.

* * * * *